US005193772A

United States Patent [19]

Johnston

[11] Patent Number: 5,193,772

[45] Date of Patent: Mar. 16, 1993

[54] ARTIST'S HAND AND BRUSH GUIDE FOR ADJUSTABLE TRAVELING MAHL

[76] Inventor: Walter G. Johnston, 10618 Rountree Rd., Los Angeles, Calif. 90064

[21] Appl. No.: 818,519

[22] Filed: Jan. 1, 1992

[51] Int. Cl.[5] ..... A47B 19/00

[52] U.S. Cl. ..... 248/118.5; 248/441.1

[58] Field of Search ..... 248/118, 118.3, 118.1, 248/118.5, 298, 441.1; 211/162, 94; 182/36

[56] References Cited

U.S. PATENT DOCUMENTS

| | | | |
|---|---|---|---|
| 194,138 | 8/1877 | Elbe | 182/36 X |
| 794,042 | 7/1905 | O'Connor | 248/118.3 |
| 3,101,568 | 8/1963 | Tratt | 248/118 |
| 4,717,109 | 1/1988 | Johnston | 248/441.1 |

*Primary Examiner*—Alvin C. Chin-Shue
*Attorney, Agent, or Firm*—William H. Maxwell

[57] ABSTRACT

A hand and brush guide manipulated the length of a mahl in the form of a beam adjusted as to height over a base supporting an artist's canvas, carriages at opposite sides of the base carrying the mahl in spaced relation over the base and supported canvas, the guide slidably carried on the mahl by antifriction bearings and positioned by a brake for steadying the artist's hand and brush, with adjustment for said spaced relation of the mahl and guide from the canvas and with braking to position them between top and bottom positions over the canvas.

17 Claims, 4 Drawing Sheets

G
60
61
M
C
B
D
5
47
48'
48
50
35
31
13,23
30
24
25
26
14,23
36
32

13
23
B
11
31,32
34

61
72
70
71
M
41
47
46
49
43
A
39
48'
23
48
D
37
45
38
5
5'
35,36
39,40
31,32

ARTIST'S HAND AND BRUSH GUIDE FOR ADJUSTABLE TRAVELING MAHL

BACKGROUND OF THE INVENTION

This invention relates to an easel and mahl, and particularly to the manipulation of a hand and brush guide for facilitating art work, it being a general object of this invention to provide a manipulatable hand and brush guide in combination with an adjustable traveling mahl over a selectively positionable canvas frame held to the easel as by magnetic means adapted for quick positioning and replacement as circumstances require.

The use of mahls is common practice among artisits, who use the device as a hand or wrist rest, usually supported upon a padded end of a stick-like member held by one hand in order to steady the other hand of the artist. Drafting boards and the like have been provided with moveable straight edges, and though there have been straight edges cambered across drawing surfaces, straight edges had not been used as a mahl for steadying the painter's hand until improvements in this art as disclosed in my U.S. Pat. No. 4,717,109 issued Jan. 8, 1988, entitled ADJUSTABLE TRAVELING MAHL AND MAGNETIC SUPPORT FOR MOUNTING ARTIST'S CANVASES. An object of this invention is to provide a hand support and guide that coextensively traverse the traveling mahl as it extends from side to side of the base.

Straight edges maintained to operate horizontally over drawing boards is common practice, and balance means is provided to carry the weight of the straight edge in said '109 patent. Also, braking means for positioning a mahl is provided to ensure sufficient stability to carry the force applied by the wrist or arm of an artist while applying paint with a brush or the like, in the '109 patent. Therefore, it is an object of this invention to provide a hand support and guide means that steadies the hand and/or brush in any selected position over the canvas and where it can be arrested by manipulation of the artist.

Rotatable drawing boards are common practice, and in combination with adjustable straight edges. Such rotation has been angularly calibrated and the drawings taped thereto. The thickness of a common canvas can vary considerably, and it has been found quite necessary that the mahl of said '109 patent be adjustable in height from the canvas supporting surface. Therefore, it is an object of this invention to provide a hand rest and guide that follows this adjustment over the canvas supporting surface, and over the supported canvas and frame as well.

Painter's canvases have been selectively placed by manipulation of magnetic retainers that adhere to the supporting surface of the table, in this instance a rotatable table that can be universally positioned as may be required for maximum comfort of the artist when exercising his or her painting proceedures. In practice, the canvas support is a magnetic laminate, and the canvas retainers are magnetic supports.

The mahl to which the guide of the present invention is attached is a rigid structural member having minimal deflection. Accordingly, the guide-rest herein disclosed is also a rigid structural member having minimal deflection characteristics. Whereas the structural span of the mahl is substantially great, the structural extension of this hand guide-rest is relatively small. Therefore, strength of material is not critical, so that a transparent acrylic plastic material is used in its construction, it being an object of this invention to retain visibility through the guide structure, so that the artist can view his or her work as it is executed.

In accordance with this invention, it is necessary that the hand guide be moved and positioned as may be required. Accordingly, it is an object to slide the guide coextensively of the mahl, and to provide antifriction means in combination with brake means for holding a selected position of the guide. In practice, the antifriction means is ball bearings, and the brake means a friction clutch.

As stated at the outset, the primary object of this invention is to provide a manipulatable hand rest and brush guide for artists. As shown herein the guide is advantageously employed with a traveling mahl as disclosed in my previous U.S. Pat. No. 4,717,109 wherein a mahl in the from of a beam is carried at an adjusted height over the painter's canvas and disposed horizontally and to move upwardly and downwardly into braked position securely positioned. The guide as it is disclosed herein is secured to the top plane of said beam and is free to coextensively tranverse the same, while being cantilevered so as to project upwardly and/or away from the artist and in the top plane of said beam. Accordingly, a hand rest is provided that overlies the canvas and which can be moved freely and alternately braked in a desired position. A feature is the rail and carriage means that controls the free condition and braked condition inherently responsive to manipulation by the artist, as will be described.

The foregoing and various other objects and features of this invention will be apparent and fully understood from the following detailed description of the typical preferred forms and applciations thereof, throughout which description reference is made to the accompanying drawings.

THE DRAWINGS

Figure 7:
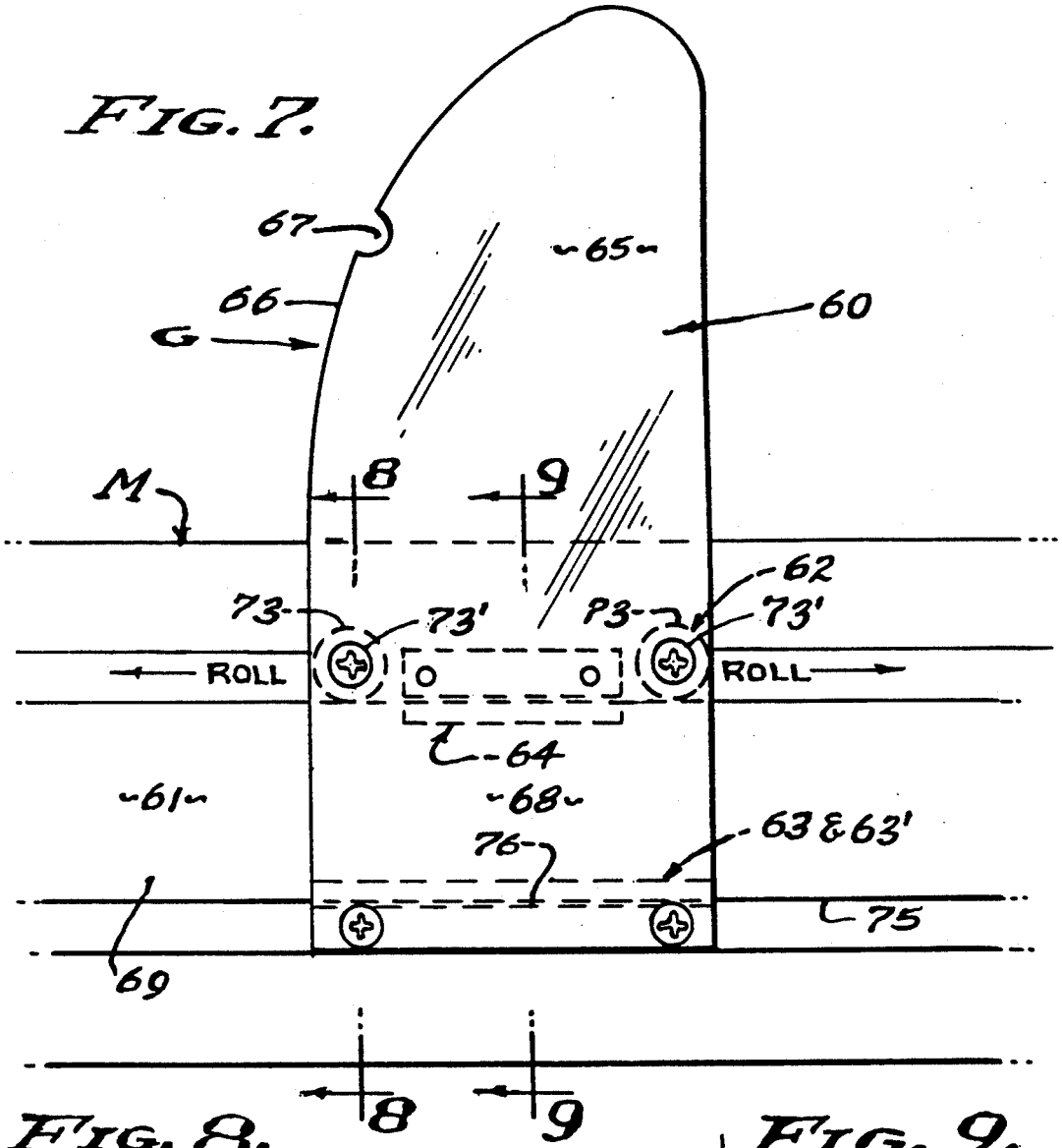
FIG. 7 is an enlarged plan view of the hand restand brush guide as it is shown in FIG. 1, and featuring the unobstructed rest surface thereof.
Figure 8:
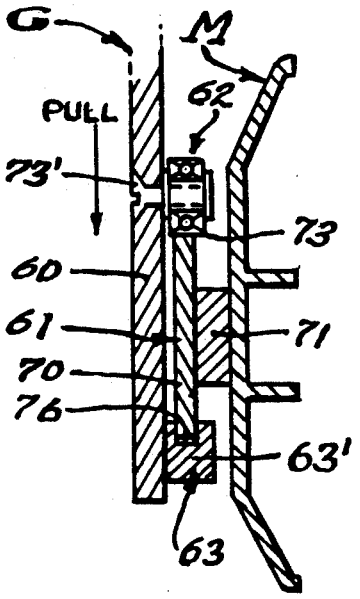
Figure 9:
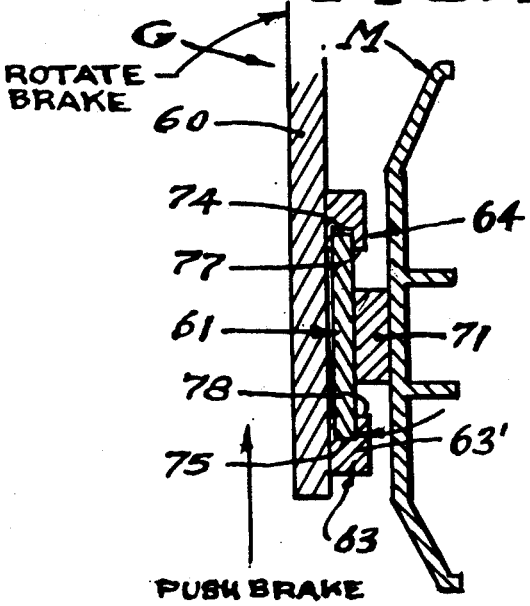

And, FIGS. 8 and 9 are enlarged detailed sectional views of the hand rest and rail support therefor, as taken by lines 8—8 and 9—9 on FIG. 7.

PREFERRED EMBODIMENT

Referring now to the drawings, there is a mahl M that is adjustable as to height over and moveable in parallel relation between top and bottom edges 10 and 11 of a base B. And there is a manipulatable hand rest rest and brush guide G positionable transversely on the mahl. The artist's workpiece or canvas C is superimposed upon the base B and a feature of this invention is that the mahl M and positionable rest-guide G pass over the canvas with clearance, as they are adjusted to the required height above the base B to do so. The parallelism of mahl M with respect to the parallel top and bottom edges 10 and 11 is invariable, and angular adjustment with respect to the canvas is by means of a rotatably positionable table T carried by the base B. Positioning of the rest-guide G is by the artist's manipulation thereof and such that position adjustments are made instantly as circumstances require.

Canvas mounting is by magnetic attraction of retainers R by which canvases or various size are mounted onto the table T. In practice, the traveling mahl M and rest-guide G can be used on a table or more conveniently used nearer to a vertical position and are therefore advantageously supported by an easel E as clearly shown in FIG. 1 of the drawings. Accordingly, the weight of the traveling mahl M and rest-guide G and associated means is counter-balanced.

This invention is characterized by the slide means S that maintains the aforesaid parallelism of the mahl M as it travels between top and bottom edges 10 and 11 of the base B, by brake means D that secures the mahl M in a selected position from top to bottom edge, and by height adjustment means A that positions the mahl M at a selected height over the surface of the base B and/or adjustable table T, and with clearance over the work in the form of an artist's canvas C or the like.

The easel E is shown as a frame 15 having a transverse foot 16 with upstanding parallel columns 17 joined by a header 18. A vertically adjustable support member 19 operates between the columns 17, with a clamp 20 in opposition to a clamp 21 at or beneath the header, the clamp 21 being vertically adjustable. An adjustable rear leg 22 angularly positions the easel. Accordingly, the easel E provides horizontally disposed and parallel clamps 20 and 21 which are adjusted in opposition to a desired height and angularity, all as circumstances require for the support of the base B as shown secured therebetween.

The base B is a flat planar member having the top and bottom edges 10 and 11 and vertical side edges 13 and 14. The base B is preferably a square adapted to be held to the frame 15 of the easel E by clamps 20 and 21 thereof. With the easel E upright as shown, the side edges 13 and 14 are substantially vertical, though they are usually slanted to certain degree. In practice, the base is made of plywood or fiberboard with edge binding of metal channel 23 which presents flat and smooth parallel margins at both the front and back sides of the base. These side margins, of channels 23, cooperate with the brake means D later described.

The artist's canvas C could be carried directly upon the front face of base B, however it is most advantageous to rotate the canvas into different positions. Therefore, the rotatably positionable table T is provided and carried by the base B concentrically therein, or thereover, within the confines of the side margins defined by the side channels 23. The table T is a circular member that turns freely on a central bearing which may vary widely in construction. As shown, the turning axis is established by a concentric opening 24 through the base B through which arcuate bearing blocks 25 bear within the opening, and with keepers 26 carried by the blocks to slideably engage the back side of the base. The rotative position of the table T can be set by a lock screw 27, and its position determined and indicated by cardinal points 28 thereon to be associated with a protractor scale 29. In practice, the scale 29 extends and is marked through 45° and the cardinal points 28 are spaced 45°, the scale 29 on the base and the cardinal points on the table.

Figure 1:
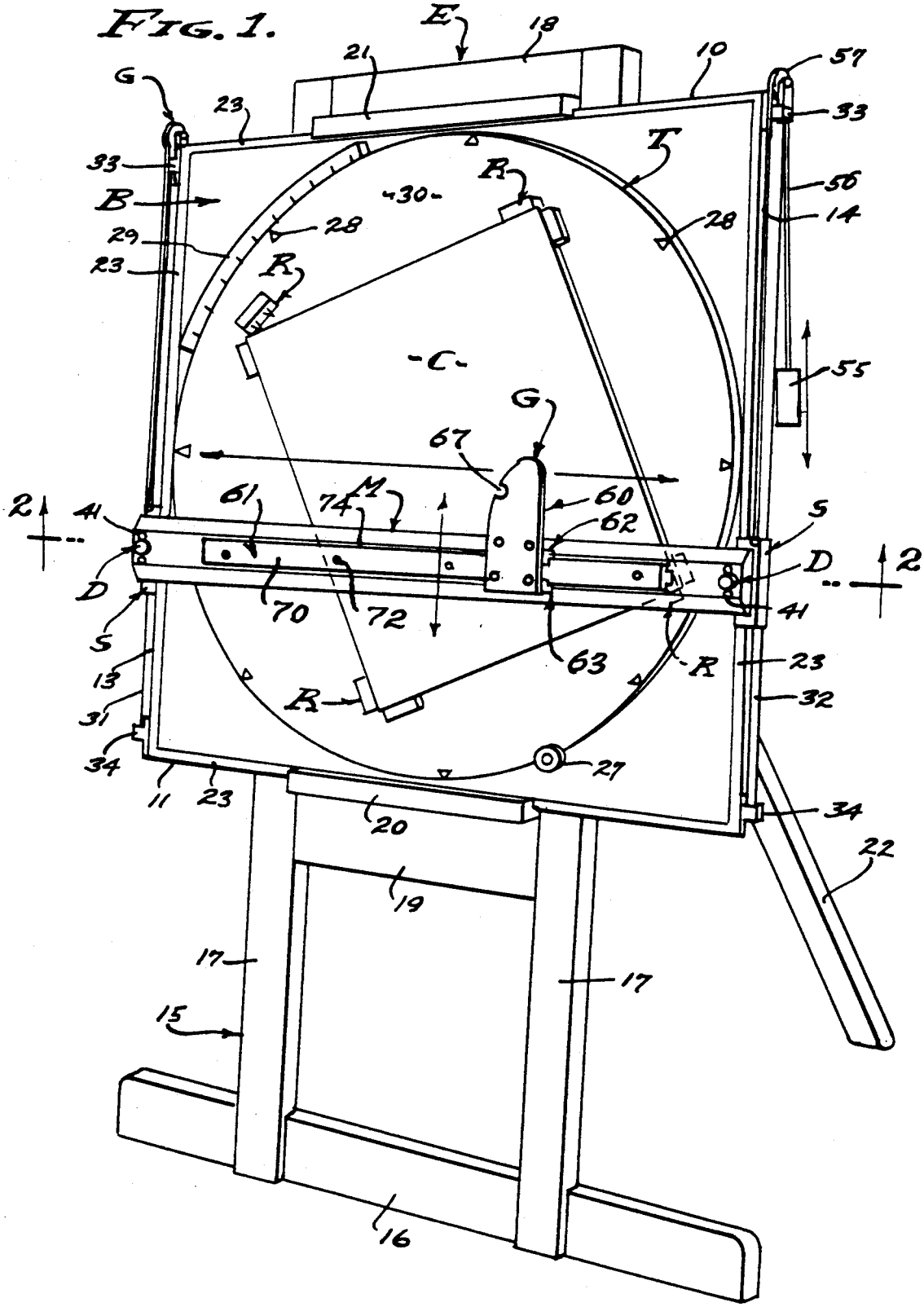
FIG. 1 is a perspective view showing the freely positionable hand guide-rest carried by the adjustable traveling mahl of the present invention mounted upon a typical artist's easel, with a canvas carried thereby beneath the guide and mahl and angularly adjusted in order to facilitate the artist's work.
Figure 2:
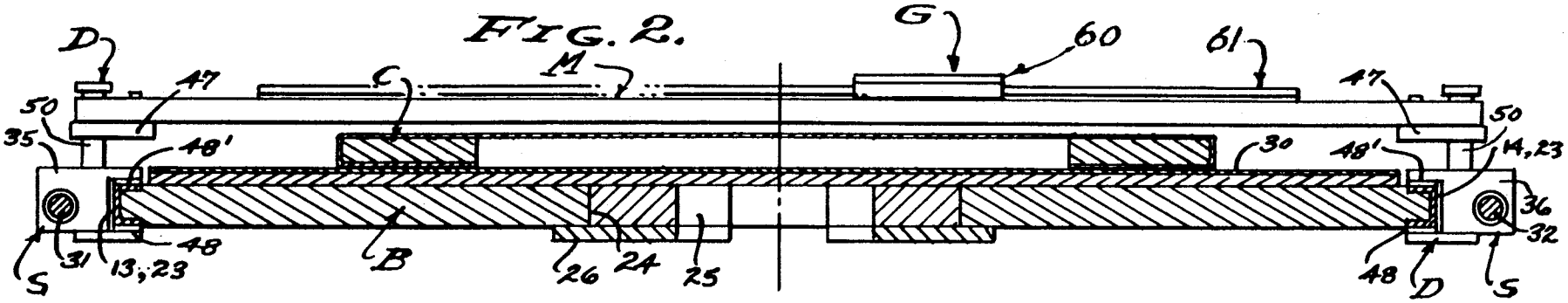
FIG. 2 is an enlarged transverse sectional view taken substantially as indicated by line 2—2 of FIG. 1, and showing the adjusted height of the guide and mahl above the canvas carried by an adjustably rotatable table.

Mounting of the artist's canvas C is by retainers R that are selectively positioned upon the table T as may be required. In carrying out this invention, the table T is a laminate member with a ferrous facing 30 in the form of sheet iron or steel, carried by a plywood or fiberboard backing. The retainers R are magnet blocks which are omni or universally positionable, there being at least one retainer R per side of the canvas C to be mounted. As shown, there is a pair of retainers R at each corner of the canvas C, it being understood that the two angularly related retainer blocks can be integral legs of a single supporting retainer. The retainers R are spiked as shown in FIG. 1, so as to bite into the frame of the canvas.

Figure 4:
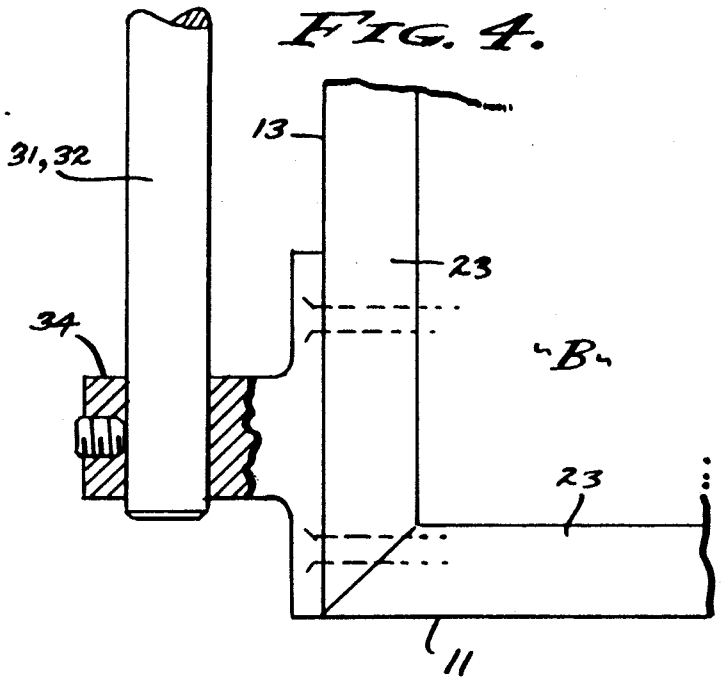
FIG. 4 is an enlarged detailed fragmentary view of one of the four corners and the base member, showing slide bar mounting, as shown at the right and left hand edges in FIG. 1.

Referring to the traveling mahl M, it is a feature of this invention that the mahl M is a rigid bar or beam-like member extending transversely over the base B and adjusted to a height spaced from the front of the base B and overlying the table T a distance to provide clearance from the canvas C mounted thereon. A requirement is that the mahl M be moveable over the canvas between and in parallel relation to the top and bottom edges 10 and 11 of the base B. To this end there is provided the slide means S that maintains the aforesaid parallelism of the mahl M as it travels over the canvas C with clearance. As shown, the slide means S comprises a rod or guide bar 31 and 32 disposed outside of and parallel to each of the side edges 13 and 14, and carriages 35 and 36 slideable on their respective bars, so as to move substantially vertically when the base B is so disposed. In practice, the bars 31 and 32 are centerless ground accurately round steel bars carried in spaced relation to edges 13 and 14 defined by the opposite side channels 23 and carried by brackets 33 and 34 at the top and bottom corners of the base B (see FIG. 4).

Figure 3:
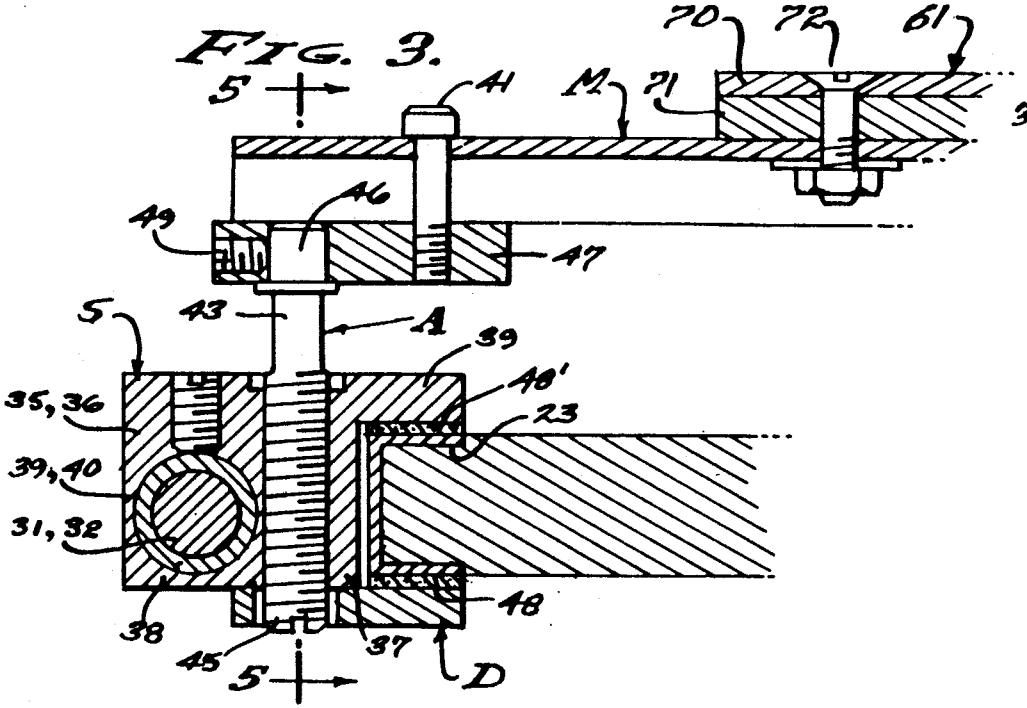
FIG. 3 is an enlarged detailed fragmentary view of the left hand mahl support and its associated parts and members, the right hand mahl support being a mirror opposite.
Figure 5:
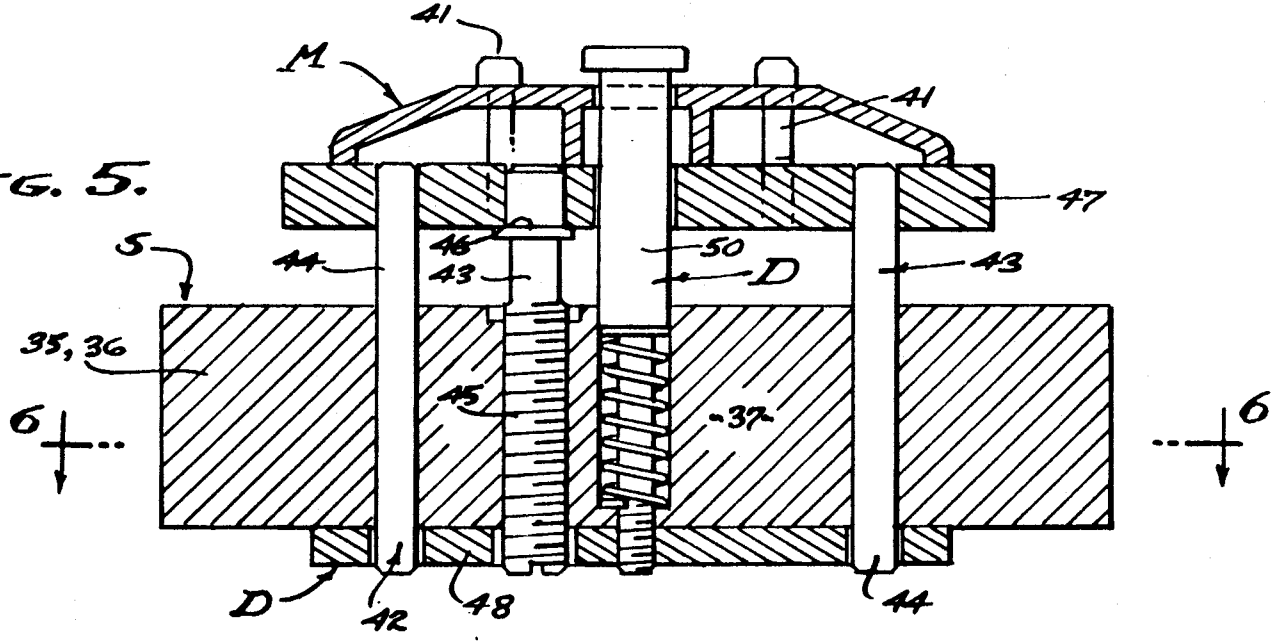
FIG. 5 is an enlarged detailed sectional view taken as indicated by line 5—5 on FIG. 3, showing the height adjustment and guides, and the mahl brake release.
Figure 6:
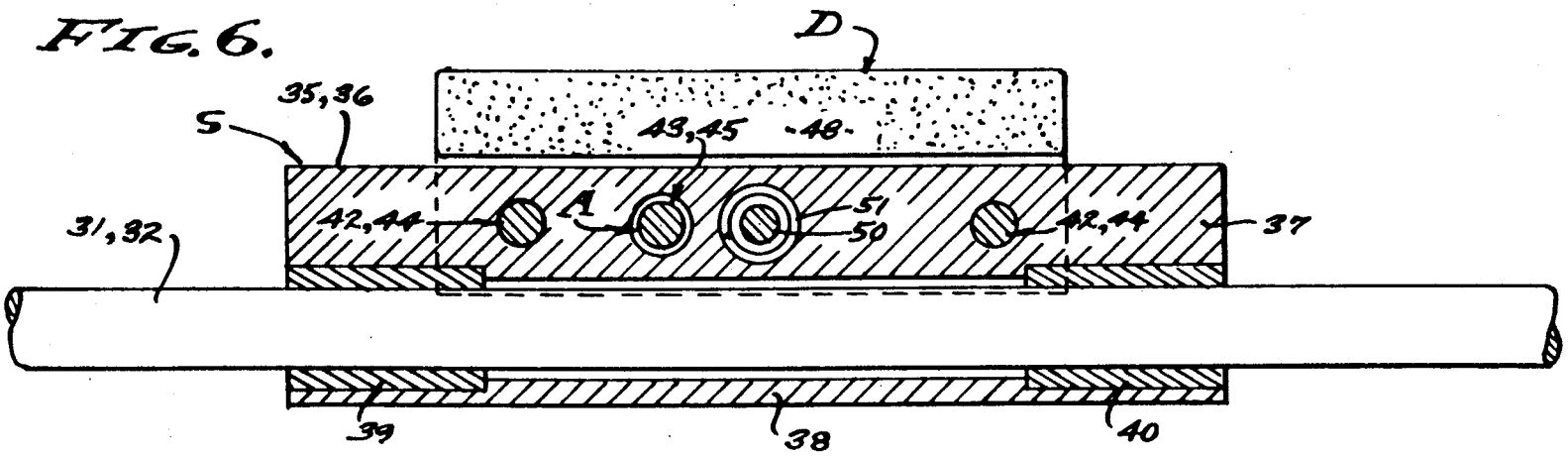
FIG. 6 is an enlarged detailed sectional view taken as indicated by line 6—6 on FIG. 5, showing the plan relationship of the various mahl control means.

The bars 31 and 32 are on coplanar parallel axes disposed between the extended planes of the front and back of the base B. The carriages 35 and 36 are alike and each includes a body portion 37 occupying the space between the supporting bar 31, 32 and side channel 23, a body portion 38 through which the bar 31, 32 slides, and a body portion 39 integral or separate overlying the marginal front of the side edge channel 23 (see FIG. 3). As shown, the carriages 35 and 36 have guide bushings 39 and 40 which travel over the bar 31, 32 for guided vertical engagement therewith. The guide bushings 39 and 40 are substantially spaced with the mahl M securely attached and rigidly adjustable as to height between the two opposite side carriages 35 and 36, being secured thereto directly or indirectly by screw fasteners 41. The mahl M is disposed horizontally at right angles to the slide bars 31 and 32 (see FIG. 1).

In accordance with this invention, I provide the height adjustment means A that determines the spaced relationship of the mahl M and hand rest-brush guide G from the base B etc., at the opposite side ends thereof. The adjustment means A is accomodated in the body portion 37 of each carriage 35 and 36, the opposite side ends of the mahl M being individually adjustable as to height from the base B. As shown, the adjustment means A comprises guide means 42 for maintaining angularlity of the mahl M and the carriages 35 and 36 while permitting adjustable separation thereof, and comprises selectively positionable support means 43 between the mahl M at the opposite ends thereof supported by the carriages 35 and 36. Like the guide means 42, the support means 43 is also accomodated in the body portion 37, of each carriage 35 and 36.

The guide means 42 for maintaining angularity of the mahl M and carriages 35 and 36 comprises spaced and parallel guide pins 44 extending through the mahl and carriages, and slideable in one or the other. In practice, there is a pair of pins 44 pressed into and carried at each end of the mahl and slideable through spaced parallel openings into the carriages. The axes of pins 44 are normal to a plane coincidental with the axes of the bars 31 and 32. Horizontal parallelism of the mahl is thereby maintained while it is free to be changed in proximity to the base B, the table T and the canvas C.

The support means 43 determines the spaced relationship of the mahl M and rest-guide G from the base B etc., and it comprises a jack 45 in the form of a threaded column having a flange shoulder 46 engageable with the back side of the mahl M to lift it to selected position spaced from the base B. The jack-screw 45 is threaded through the body portion 37 of the carriage (35, 36,) where it is slotted or otherwise fashioned to be operated by a hand tool or the like. In practice, there is a header 47 at each end of the mahl M, to carry the pins 44 and to receive the shouldered jack 45. As next described, the headers 47 also pass a manually depressible control rod for the brake means D.

The brake means D secures the mahl M and rest-guide G in any selected position between the top and bottom edges 10 and 11 of base B, and is comprised of releasable friction means at one or both of the carriages 35 and 36. In practice, there is a manually releasable friction pad 48 disengageable from the margin of the base B defined by the channel 23. As shown, the pad 46 is comprised of a brake lining carried by a back plate guided by the pins 44 and with an access opening for the operating jack 45. The jack 45 has a set screw 49 carried by the header 47 to engage a head thereof above said flange shoulder 46. The header 47 and mahl M freely pass a control rod 50 for depressing the pad 48, thereby releasing it from the channel 23.

The brake means D is normally set and the pad 48 yieldingly urged into pressured engagement with the channel 23 by a spring 51 operable over a reduced portion of the rod 50 extending through the bottom of the body portion 37 to engageably carry the pad 48. The control rod 50 is shouldered so as to be lifted by the spring 51 carried over the reduced portion of the rod, and there is a manually operable button exposed at or above the mahl for manual depression of the rod and attached brake pad 48. In the preferred form, the brake means D is of the caliper type, wherein the moveable brake pad 48 is opposed by a static brake pad 48' carried by the body portion 39 and engageable with the opposite front side of the channel 23. The pade 48' at each end of the mahl M have a dual function of positioned support for the mahl as well as for braking.

The weight of the mahl M and rest-guide G carried thereby and of the dynamic means associated therewith as hereinabove described is counterbalanced by gravity pulled weight 55 drawing a cable 56 over a pulley 57 at each side of the base B, the cables of such means being attached to the carriages 35 and 36 as shown.

Referring now to the rest-guide G, it is a feature of this invention that the rest-guide is a rigid member that cantilevers upwardly from the traveling mahl free to be moved and positionably manipulated by the artist, as circumstances require. That is, the rest-guide G in its passive condition is free to traverse the horizontal extent of the mahl M, and upon the application of force by manipulation the rest-guide is positioned in a stopped condition. As shown in FIGS. 7 and 8 the rest-guide G is free to traverse right or left, and in FIG. 9 it is shown braked by applied upward and/or rotational force. In FIG. 1 the rest-guide is shown positioned to overlie the artist's canvas C, the horizontal arrows indicating the traverse capability for positioning the rest guide, and comprised generally of a hand support 60, a track 61, transport means 62 for traverse of the support 60 upon track 61, a brake means 63 to stop the support on the track, and and keeper and fulcrum means 64 to capture and permit rotation of the hand support 60 on the track.

The hand support 60 closely overlies the mahl M and is preferably a flat plate disposed to overlie a tip face of the mahl and project upwardly in space parallel relation to the canvas C. For visibility of the art work in process, the hand support 60 is made of a transparent material such as an acrylic plastic. In practice, the upper area 65 of the projecting portion of the rest-guide G is approximately that of the palm of the artist's hand, as shown in FIG. 7, and formed so as to enable brushing movement of the hand. In practice, and for a right handed artist, the left side edge 66 of the rest-guide is convexly arcuate, whereby the artist's hand can be turned at the wrist with an underlying arcuate support for any one or more fingers, while providing clearance for the brush, pen or pencil shaft that is being used. A feature is the guide notch 67 to engage the brush, pen or pencil (not shown, whereby strict rectilinear motion can be ensured, either transversely or upwardly and downwardly. The lower area 68 of the rest-guide G overlies the top face of the mahl M.

The track 61 can vary in design, for example a slot or groove in the mahl M, and is preferably a T-bar 61 at the top face of the mahl. This T-bar track can be integrally extruded with the mahl or it can be a separate member as shown fabricated of two pieces for convenience and to ensure straightness. Accordingly, the T-bar track 61 as it is shown is comprised of a double edged track bar 70 carried in spaced parallel relation over the mahl M by a parallel bar 71. The track assembly is secured as by a series of screw fasteners 72, as shown. In practice, the track 61 assembly terminates at opposite ends short of the mahl brake means D (see FIGS. 1 and 3), thereby enabling installation and removal of the rest-guide hand support 60.

The transport means 62 provides freedom of the rest-guide hand support 60 to traverse the horizontal extent of the mahl M, and is an anti-friction carrier therefor. In the preferred form the transport means 62 is one or more and shown as a pair of spaced ball bearing assemblies 73 comprised of inner and outer races separated by balls captured therebetween. The inner races are secured to the hand support 60 by fasteners 73' as shown and the outer races roll on the top edge 74 of the track bar 70 (see FIG. 7) when pulled downward by gravity and/or by deliberate pressure imposed by the artist.

The brake means 63 provides selective positioned securement of the hand support 60 by manipulative force imposed by the artist. To this end a brake block 63' is closely spaced from the lower marginal portion 75 of the track bar 70 (see FIG. 7) when the bearing assemblies are engaged with said track bar, thus establishing a free rolling condition. Alternately, a braked condition is established by forceful upward or rotative manipulation through the artist's hand or wrist engaged upon the hand support 60. Accordingly, the brake block 63' presents elongated brake interfaces 76 at the bottom and sides of said marginal portion 75, as clearly shown in FIG. 9, to stop the hand support 60 upon downward and/or rotative force applied thereto as is indicated.

The keeper means 64 captures the hand support 60 upon the tract 61, and is preferably pairs of flanges 77 and 78 that closely underly the top and bottom margins of the track bar 70. In practice, the lower flanges 78 are integral with the brake block 63', while the upper flanges 77 are integral with a similar block disposed between the bearing assemblies 73. The keeper flanges clear the track bar and do not impede transport of the hand support. The flanges are secured by pins or screw fasteners or the like.

From the foregoing, it will be understood that I employ a traveling mahl particularly suitable for use by artist's, in order to steady the brush hand with respect to the canvas. The canvas is turned relative to the mahl and it is a primary object that the artist's posture remains erect and comfortable, while executing any and all brush strokes and the like. Further, the canvas is often required to be prepared with suitable grids, guide lines, and/or perspective lines, in preparation for the art work to be performed. And to this end the rest-guide G and its notch 67 are used for rectilinear motion of the artist's instrument being used.

The rest-guide G is manipulated by the artist to traverse the mahl M and to be set in any desired transverse position on said mahl. The rest-guide G is inherently free to roll on its anti-friction bearing assemblies 73 when downward force is applied as by the weight of the artist's hand (see FIG. 8). However, when upward or rotational force is deliberately applied by the artist's hand (see FIG. 9), the brake means 63 is operated to stop the rest-guide G by means of frictional engagement of brake block 63' with the interface 76 at the bottom marginal portion of the track 61. Accordingly, the artist's hand and instrument used are steadied.

Having described only the typical preferred form and applications of my invention, I do not wish to be limited or restricted to the specific details herein set forth, but wish to reserve to myself any modifications or variations that may appear to those skilled in the art as set forth within the limits of the following claims.

I claim:

1. A hand rest-guide in combination with a traveling mahl for steadying an artist's hand over a workpiece supported upon a planar base, the traveling mahl being comprised of a rigid member extending horizontally between slide means at opposite side edges of the base and carried thereby to travel upwardly and downwardly in spaced relation to and over the workpiece, there being means to position said member on said slides, the hand rest-guide being comprised of a track carried by the rigid member of the traveling mahl and extending transversely thereon between opposite side edges of the base, a hand support carried by transport means therefor engaged on the track to freely traverse between said opposite side edges of the base, and brake means comprising a brake block to position the hand support along the track.

2. The hand rest-guide and traveling mahl combination as set forth in claim 1, wherein the hand support of the hand rest-guide projects upwardly from the rigid member of the traveling mahl and overlies the planar base and workpiece supported thereon.

3. The hand rest-guide and traveling mahl combination as set forth in claim 2, wherein the projecting hand support is to transparent material for viewing the workpiece.

4. The hand rest-guide and traveling mahl combination as set forth in claim 1, wherein the track of the hand rest-guide is a straight member carried on a top plane of said rigid member of the traveling mahl.

5. The hand rest-guide and traveling mahl combination as set forth in claim 1, wherein the transport means of the hand rest-guide is an anti-friction means supported upon the track.

6. The hand rest-guide and traveling mahl combination as set forth in claim 1, wherein the transport means of the hand rest-guide is a pair of spaced anti-friction bearing assemblies supported upon the track.

7. The hand rest-guide and traveling mahl combination as set forth in claim 1, wherein the brake means of the rest-guide is a friction means engageable with the track.

8. The hand rest-guide and traveling mahl combination as set forth in claim 1, wherein the transport means of the hand rest-guide is an anti-friction means supported upon a top edge of the track, and wherein the brake means is a friction means engageable with a bottom marginal portion of the track.

9. The hand rest-guide and traveling mahl combination as set forth in claim 1, wherein the transport means of the hand rest-guide is an anti-friction means supported upon a top edge of the track, and wherein the brake means is on the hand support and upwardly shiftable therewith into interface engagement with a bottom marginal portion of the track by manipulation.

10. The hand rest-guide and traveling mahl combination as set forth in claim 1, wherein the transport means of the hand rest-guide is a pair of spaced anti-friction bearing assemblies supported upon a top edge of the track, and wherein the brake means is on the hand support and upwardly shiftable therewith into interface engagement with a marginal portion of the track by manipulation.

11. The hand rest-guide and traveling mahl combination as set forth in claim 1, wherein the transport means supportably engages a top edge of the track, wherein the brake means frictionally engages a bottom marginal portion of the track, and wherein a keeper means captures the hand support to the track.

12. The hand rest-guide and traveling mahl combination as set forth in claim 1, wherein the transport means supportably engages a top edge of the track, wherein the brake means frictionally engages a bottom marginal portion of the track, and wherein a keeper means comprised of a flange underlying the track captures the hand support to the track.

13. The hand rest-guide and traveling mahl combination as set forth in claim 1, wherein the transport means supportably engages a top edge of the track, wherein the brake means frictionally engages a bottom marginal portion of the track, and wherein a keeper means comprised of a pair of flanges underlying top and bottom margins of the track capture the hand support to the track.

14. The hand rest-guide and traveling mahl combination as set forth in claim 2, wherein the hand support has an accessible notch to receive and position an artist instrument.

15. The hand rest-guide and traveling mahl combination as set forth in claim 2, wherein the hand support has a convexly arcuate side edge, whereby an artist's hand can be turned at the wrist with clearance for an artist instrument held by said hand.

16. The hand rest-guide and traveling mahl combination as set forth in claim 1, wherein the transport means of the hand rest-guide is an anti-friction means supported upon a top edge of the track, and wherein the brake means is on the hand support and closely spaced from a bottom edge of the track and upwardly shiftable with the hand support by manipulation and into interface engagement with said bottom edge of the track.

17. The hand rest-guide and traveling mahl combination as set forth in claim 1, wherein the hand support of the hand rest-guide projects upwardly from the rigid member of the traveling mahl and overlies the planar base and workpiece supported thereon, wherein the transport means of the hand rest-guide is an anti-friction means supported upon and pivotally captured to the top edge margin of the track by a keeper flange closely underlying the top edge margin of the track, and wherein the brake means is on the hand support at a bottom edge margin of the track and captured to the bottom edge margin of the track by a keeper flange closely underlying the bottom edge margin of the track and shiftable with the hand support when pivoted by manipulation and into interface engagement with said bottom edge margin of the track.

* * * * *